United States Patent [19]

Tashiro et al.

[11] Patent Number: 4,991,387

[45] Date of Patent: Feb. 12, 1991

[54] POLYESTER AND COTTON BLENDED YARN AND POLYESTER STAPLE FIBER STOCK USED THEREIN

[75] Inventors: Mikio Tashiro; Akira Kimura; Tsukasa Kobayashi, all of Matsuyama; Nobuharu Izawa; Tamio Mitamura, both of Kobe; Sei Tanizawa, Kashihara, all of Japan

[73] Assignee: Teijin Limited, Osaka, Japan

[21] Appl. No.: 444,122

[22] PCT Filed: Mar. 30, 1989

[86] PCT No.: PCT/JP89/00336

§ 371 Date: Nov. 18, 1989

§ 102(e) Date: Nov. 18, 1989

[87] PCT Pub. No.: WO89/09297

PCT Pub. Date: Oct. 5, 1989

[30] Foreign Application Priority Data

Mar. 30, 1988 [JP] Japan ..... 63-74834

[51] Int. Cl.[5] ..... D02G 3/04; D02G 3/02; D02G 3/22; D02G 3/24

[52] U.S. Cl. ..... 57/256; 19/145.5; 57/253; 57/254; 57/255; 57/315; 428/401

[58] Field of Search ..... 57/5, 200, 206–208, 57/224, 238, 239, 243–245, 252–257, 315, 317, 328, 351; 19/0.3–0.64, 145.5, 145.7, 150; 428/224, 225, 357, 359, 362, 364, 365, 369, 397–401

[56] References Cited

U.S. PATENT DOCUMENTS

| | | | |
|---|---|---|---|
| 2,172,439 | 9/1939 | Dreyfus et al. | 57/254 |
| 2,260,229 | 12/1941 | Nutter et al. | 57/252 X |
| 3,007,227 | 11/1961 | Moler. | 57/254 X |
| 3,018,521 | 1/1962 | Harmon | 19/150 |
| 3,046,724 | 7/1962 | Ward | 57/254 |
| 3,157,021 | 11/1964 | Kitson et al. | 57/254 |
| 3,188,790 | 6/1965 | Hebeler | 57/256 X |
| 3,293,110 | 12/1966 | Stine, Jr. et al. | 57/253 X |
| 3,371,475 | 3/1968 | Gorrafa | 57/256 |
| 3,587,220 | 6/1971 | Eggleston | 57/256 |
| 3,852,948 | 12/1974 | Ruddell et al. | 57/256 X |
| 3,913,309 | 10/1975 | Chiarotto | 57/256 X |
| 3,965,664 | 6/1976 | Goetti et al. | 57/256 X |
| 4,006,277 | 2/1977 | Laird | 428/401 X |
| 4,384,450 | 5/1983 | Sawyer | 57/254 |
| 4,466,237 | 8/1984 | Sawyer | 57/256 |

FOREIGN PATENT DOCUMENTS 50-112529 9/1975 Japan .

*Primary Examiner*—John Petrakes
*Attorney, Agent, or Firm*—Burgess, Ryan & Wayne

[57] ABSTRACT

The present invention relates to a polyester and cotton blended yarn capable of obtaining a polyester and cotton blended fabric having a superior bulkiness and a soft touch, and a polyester staple fiber stock which is useful to obtain the blended yarn as a yarn having superior properties with regard to neps and a yarn uneveness. To obtain the above-mentioned polyester cotton blended yarn, a coarse denier staple fiber having a predetermined range of fineness and a fine denier staple fiber having a predetermined range of fineness are used, and a suitable number of staple fibers constituting the blended yarn and fiber lengths of the staple fibers are defined in the present invention.

6 Claims, 3 Drawing Sheets

POLYESTER AND COTTON BLENDED YARN AND POLYESTER STAPLE FIBER STOCK USED THEREIN

TECHNICAL FIELD

The present invention relates to a polyester and cotton blended yarn and a polyester staple fiber stock used in the polyester and cotton blended yarn.

BACKGROUND ART

A woven fabric or a knitted fabric (hereafter referred to as a fabric) using spun yarns of a polyester staple fiber has been widely used in various applications and has superior qualities. Nevertheless, this fabric has disadvantages in that the bulkiness thereof is unsatisfactory and the touch is not soft, giving a paper-like handling, and an elimination of the above disadvantages is a serious technical problem when dealing with this fabric. The above paper-like handling also appears in a blended yarn of the polyester staple fiber and a cotton fiber or a fabric using the polyester and cotton blended yarn. Although it has been proposed that high class cotton fibers such as Egyptian cotton be used as the cotton fibers to eliminate the paper-like handling, the use of such high class cottons does not give a soft touch to the fabric, and therefore, it is not possible to thereby obtain a fabric having a high quality.

The use of a polyester staple fiber of a fine denier has been proposed as an attempt to solve the above-mentioned problems, but the touch of the fabric using the polyester staple fiber of the fine denier becomes surely to soft. Moreover, problems such as an unsatisfactory bulkiness and resiliency of this fabric, which are important characteristics of the fabric appeared in this fabric. Further, a polyester staple fiber having a fine denier, particularly a polyester staple fiber having a denier of 1.0 denier or less, is likely to generate neps during a carding process and an unevenness of the sliver obtained is likely to become larger. Even if a countermeasure such as a lowering of a rotational number of a doffer in a carding machine or the like is adopted, it is not possible to obtain a sufficient improvement. Further, this method is not preferable because the productivity of the spun yarn is remarkably lowered.

As another attempt to solve this problem, a blended yarn using a plurality of staple fibers, in which the fiber length of the fibers is changed, has been disclosed in the specification of U.S. Pat. No. 4,466,237. The bulkiness of the fabric obtained by this method is slightly improved, but conversely, the touch of this fabric is very coarse. Further, since staple fibers having a short fiber length are blended to the yarn without a change in the number of the fibers constituting the yarn, a problem of a lower strength of the blended yarn arises.

A method of blending staple fibers having a coarse denier and cut to a long fiber length with staple fibers having a fine denier and cut to a short fiber length, in a spinning process, is disclosed in Japanese Unexamined Pat. Publication (Kokai) No. 59-26537 as a method using a staple fiber having a fine denier. Nevertheless, the uniformity of the obtained yarn and an improvement of the paper-like handling of a fabric using this yarn are unsatisfactory, and the productivity level of this method is low. The above unsatisfactory performance occurs because a method of blending the staple fibers used is inferior to a blending method used in a conventional spinning process, i.e., a blending method in a scutching process or a drawing process due to use of a staple fiber having a fine denier and a staple fiber having a coarse denier which greatly different from the denier of the fine denier staple fiber. Namely, a surface area of the staple fiber of the fine denier is remarkably larger than that of the staple fiber of the coarse denier, and therefore, it is considered that the above unsatisfactory performance is due to an increased friction between the staple fibers having a fine denier, and when the fine denier staple fiber is blended with the coarse denier staple fibers, the separation of the fine denier staple fibers is insufficient and blocks of the fine denier staple fibers are generated in the spun yarn.

DISCLOSURE OF THE INVENTION

A primary object of the present invention is to eliminate the above-mentioned problems of the prior art, and to provide a polyester and cotton blended yarn having a superior uniformity and allowing a manufacture of a fabric having a superior bulkiness and soft touch.

A second object of the present invention is to provide a polyester staple fiber stock used to spin the polyester and cotton blended yarn according to the primary object, as a staple fiber stock, and in which at least two types of polyester staple fibers having different deniers and fiber lengths are blended.

The primary object of the present invention can be attained by a polyester and cotton blended yarn composed of polyester staple fibers and cotton fibers at a blending ratio of the polyester staple fibers and the cotton fiber in the yarn of between 65 to 35 and 35 to 65, characterized in that a mean number (N) of the polyester staple fibers included in a cross section of the blended yarn is at least 10 or more, and the polyester staple fibers are constituted by two or more different types of denier polyester staple fibers including a coarse denier polyester staple fiber having a denier ($D_1$) which satisfies the equation $1.8 \geqq D_1 \geqq 1.0$ and a fine denier polyester fiber having a denier ($D_2$) which satisfies the equation $1.0 \geqq D_2 \geqq 0.4$, the two or more types of different denier polyester staple fibers being blended under conditions satisfying the following equations and being present in a mutually blended state in the cross sectional area of the blended yarn.

$$D_1/D_2 \geqq 1.25 \quad (1)$$

$$0.30\,N \geqq N_1 \geqq 0.05\,N \quad (2)$$

$$16.1\,D_i + 26 \geqq L_i \geqq 10.2\,D_i + 10 \quad (3)$$

$$(i = 1, 2)$$

$$44 \geqq L_1 \geqq 1.18\,L_2 \quad (4)$$

Wherein N stands for a mean number of the polyester staple fibers included in the cross section of the blended yarn, $N_1$ stands for a mean number of the coarse denier polyester staple fibers included in the cross section of the blended yarn, $L_1$ stands for a mean fiber length of the coarse denier polyester staple fibers, and is expressed in mm, $L_2$ stands for a mean fiber length of the fine denier and is expressed in mm.

The second object of the present invention can be attained by a polyester staple fiber stock used for a polyester and cotton blended yarn, characterized in that the stock includes two or more types of polyester staple fibers in a blended state and is packed into a packing bale to be transported from a process of manufacturing the polyester staple fiber to a spinning process thereof, and each staple fiber satisfies the following equations:

$$D_1/D_2 \geqq 1.25 \quad (1)$$
$$1.8 \geqq D_1 \geqq 1.0 \quad (6)$$
$$1.0 > D_2 \geqq 0.4 \quad (7)$$
$$65 \geqq M_1 \geqq 5 \quad (8)$$
$$95 \geqq M_2 \geqq 35 \quad (9)$$
$$16.1\ D_i + 26 \geqq L_i \geqq 10.2\ D_i + 1.0 \quad (3)$$
$$(i = 1, 2)$$
$$44 \geqq L_1 \geqq 1.18\ L_2 \quad (4)$$

Wherein $D_1$ stands for a fineness of a coarse denier staple fiber and is expressed by de, $D_2$ stands for a fineness of a fine denier staple fiber and is expressed by de, $M_1$ stands for a blending ratio of the coarse denier staple fiber and is expressed by weight %, $M_2$ stands for a blending ratio of the fine denier staple fiber and is expressed by weight %, $L_1$ stands for a mean fiber length of the coarse denier staple fiber and is expressed in mm, and $L_2$ stands for a mean fiber length of the fine denier staple fiber and is expressed in mm.

BEST MODE OF CARRYING OUT THE INVENTION

Figure 1:
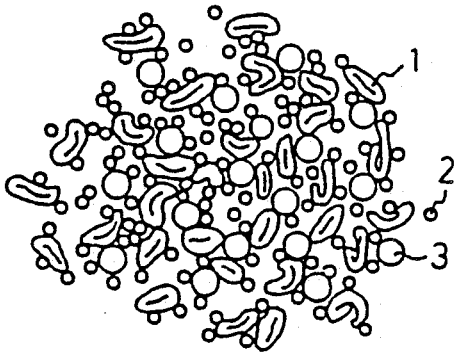
FIG. 1 is a cross sectional view illustrating an example of a yarn blended in accordance with the present invention.

As shown in a cross sectional view, i.e., a transverse sectional view of FIG. 1, a polyester and cotton blended yarn in accordance with the present invention is a spun yarn in which a cotton fiber 1 and polyester staple fibers 2 and 3 are spun in a blended state, and the fine denier polyester staple fibers 2 and the coarse denier polyester staple fibers 3 are arranged in a substantially uniformly dispersed state. Particularly, the coarse denier polyester staple fibers 3 are separated into single staple fibers without forming a block and are arranged in an axial direction of the yarn so that a yarn unevenness is minimized.

Mean number N of the polyester staple fibers in the polyester and cotton blended yarn in accordance with the present invention must be 10 or more, and more preferably, N satisfies the equation $N \geqq 15$. When the mean number of the staple fiber is lower than 10, it is difficult to maintain a uniform blending ratio of the polyester staple fibers against the cotton fibers in an axial direction of the blended yarn, and yarn unevenness is often generated in the obtained yarn.

A blending ratio of the polyester staple fibers and the cotton fibers in the polyester and cotton blended yarn in accordance with the present invention is between 65 to 35 and 35 to 65.

The polyester staple fibers in the polyester and cotton spun yarn in accordance with the present invention are constituted of two or more types of different denier polyester fibers, and a fine denier polyester staple fiber and a coarse denier polyester staple fiber satisfying the following conditions, respectively, are blended.

When a denier of a single staple fiber of the fine denier polyester staple fiber is $D_2$, the staple fiber in the range of the equation $1.0 > D_2 \geqq 0.4$ is used as the fine denier polyester staple fiber. It is necessary to blend a fine denier staple fiber having the abovementioned denier to provide a soft touch of the obtained blended yarn. It is undesirable to use a staple fiber having a denier of less than 0.4 de, because a passability, i.e., processability, of the staple fiber in a carding machine is lowered.

When a denier of a single staple fiber of the coarse denier polyester staple fiber is $D_1$, the staple fiber in the range of the equation $1.8 \geqq D_1 \geqq 1.0$ is used as the coarse denier polyester staple fiber. It is undesirable to use a staple fiber having a denier of more than 1.8 de, as the touch of the obtained blended yarn becomes harsh. Also, it is undesirable to use a staple fiber having a denier of less than 1.0 de as the coarse denier polyester staple fiber of the polyester and cotton blended yarn in accordance with the present invention, as this leads to a lower productivity in a spinning process.

It is necessary that the following condition is satisfied between the denier $D_1$ of the coarse denier polyester staple fiber and the denier $D_2$ of the fine denier polyester staple fiber, which belong in the above-mentioned ranges, respectively.

$$D_1/D_2 \geqq 1.25 \quad (1)$$

Namely, when $D_1/D_2$ is under 1.25, a denier of the coarse denier staple fiber is too close to that of the fine denier staple fiber and the blending of two or more types of different staple fiber cannot be attained.

Note, sometimes a uniform blending of the coarse denier staple fiber and the fine denier staple fiber becomes difficult due to an increase of the $D_1/D_2$. Therefore, an allowable upper limit of $D_1/D_2$ is 4.50, and this value corresponds to an upper limit of combinations selected from the range defined by the equation $1.0 > D_2 \geqq 0.4$ and the range defined by the equation $1.8 > D_1 \geqq 1.0$.

A number $N_1$ of the coarse denier staple fiber in the total polyester staple fiber used is also an important factor, and this number $N_1$ must satisfy the following equation (2).

$$0.30\ N \geqq N_1 \geqq 0.05\ N \quad (2)$$

When $N_1$ is less than 0.05 N, an effect obtained from the coarse denier staple fiber used to obtain a superior bulkiness of a fabric or a relatively large volume of the fabric and a superior resiliency does not appear. When $N_1$ is more than 0.30N, a blending ratio of the fine denier staple fiber is lowered, and thus a soft touch fabric cannot be obtained.

The effect of a fiber length of the polyester staple fiber in the polyester and cotton blended yarn in accordance with the present invention will be explained hereafter.

A fine denier staple fiber such as a staple fiber having a denier within the range defined by the equation $1.0 > D_2 \geqq 0.4$ generally has an inferior processability in the carding machine, resulting in a generation of neps and poor yarn evenness. To reduce the generation of neps and improve the yarn evenness, it is preferable to shorten a mean fiber length $L_2$ expressed in mm of the fine denier staple fiber according to the denier $D_2$ of the fine denier staple fiber. Such a relationship is also allowable between a mean fiber length $L_1$ expressed in mm of the coarse denier staple fiber and the denier $D_1$. Namely, the polyester staple fiber in the polyester and cotton blended yarn in accordance with the present invention may be selected so that a relationship between the denier and the mean fiber length of the single staple fiber satisfies the following equation.

$$16.1\ D_i+26 \geqq L_i \geqq 10.2\ D_i+10 \quad (3)$$

Wherein i=1.2.

For example, when $D_2$ is 0.4 de, the fine denier staple fiber having the mean fiber length $L_2$ satisfying the equation $32.4 \geqq L_2 \geqq 14.08$ is used. When a staple fiber having the same mean fiber length as that of the above-mentioned fine denier staple fiber is used as a coarse denier staple fiber to be blended with the fine denier staple fiber, an increased yarn unevenness is generated. It appears that this increase of the yarn unevenness is due to a poor concordance between the fine denier staple fibers and the coarse denier staple fibers, because of an increased friction at the fine denier staple fiber caused by remarkable increase of a surface of the fine denier staple fiber. It has been found that the above problem can be alleviated by making the mean fiber length of the coarse denier staple fiber longer. Namely, a mean fiber length $L_1$ and a denier $D_1$ of the coarse denier staple fiber must satisfy the above equation (3) and the following equation.

$$44 \geqq L_1 \geqq 1.18\ L_2 \quad (4)$$

Although neps and the yarn unevenness can be reduced by shortening the mean fiber length $L_2$ of the fine denier staple fiber as described herebefore, conversely it becomes difficult to improve the arrangement of the fine denier staple fiber in the blended yarn when the mean fiber length of the fine denier staple fiber is shortened, and a problem arises in that a luster of the obtained blended yarn is remarkably reduced. Namely, the luster of the blended yarn is increased by blending the coarse denier staple fiber having a long mean fiber length. It appears that the increase of the luster of the blended yarn is due to an improved arrangement of the fine denier staple fiber in the blended yarn caused by the presence of the coarse denier staple fiber.

As described above to obtain a blended yarn having a superior quality, the fiber length $L_1$ of the coarse denier staple fiber and the fiber length $L_2$ of the fine denier staple fiber in the polyester fiber used in the blended yarn must satisfy the above equation (3) and the above equation (4).

Figure 2:
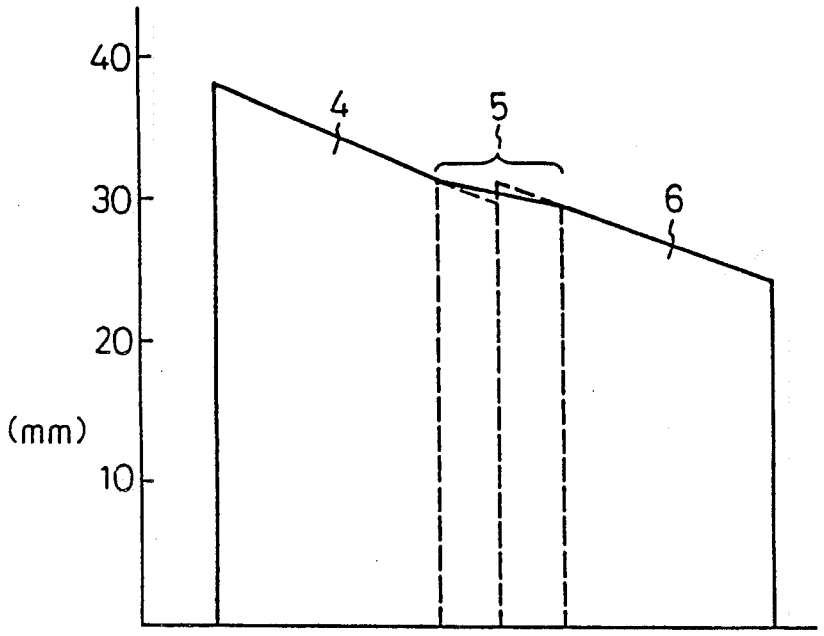
FIG. 2 is a view illustrating an example of a staple diagram of a polyester staple fiber stock in accordance with the present invention.

To further improve the yarn quality of the polyester and cotton blended yarn in accordance with the present invention, it is preferable to use polyester staple fibers in which the fiber lengths are continuously changed, instead of polyester staple fibers having the same fiber length. For example, when the coarse denier polyester staple fibers having a biased cut distribution in which the fiber lengths are continuously changed are used, the yarn quality of the blended yarn is improved. Further, it is preferable to use staple fibers having a biased cut distribution in which the fiber length is continuously changed, as the coarse denier staple fibers and the fine denier staple fibers, and it is preferable that, as shown in FIG. 2, a superimposed portion 5 is arranged between a fiber length distribution 4 of the coarse denier staple fibers and a fiber length distribution 6 of the fine denier staple fibers, or the total fiber length distribution is defined in such a manner that the fiber length distribution 4 and the fiber length distribution 6 are continuous.

When both fiber length distributions are biased cut distributions, it is preferable that fiber lengths of the coarse denier staple fiber and the fine denier staple fiber are selected in such a manner that those fiber lengths satisfy the following equation (5).

$$\frac{(L_{1max} + 2L_{1min})}{3} \geqq L_{2max} \geqq L_{1min} \geqq \frac{(2L_{2max} + L_{2min})}{3} \quad (5)$$

Wherein $L_{1max}$ stands for a maximum fiber length of the coarse denier polyester staple fiber and is expressed in mm, $L_{1min}$ stands for a minimum fiber length of the coarse denier polyester staple fiber and is expressed in mm, $L_{2max}$ stands for a maximum fiber length of the fine denier polyester staple fiber and is expressed in mm, $L_{2min}$ stands for a minimum fiber length of the fine denier polyester staple fiber and is expressed in mm.

When a fiber having a long fiber length such as a wool is blended with a polyester staple fiber, it is known that polyester staple fibers having a biased cut distribution could be used to improve a yarn unevenness of the blended yarn. But when a fiber having a short fiber length such as a cotton fiber is blended with the polyester staple fiber, the effect obtained by using the polyester staple fibers having the biased cut distribution is small, and therefore, those polyester staple fibers are rarely used. Particularly, a polyester staple fiber having a finer denier, such as that used in the present invention, must be cut to a shorter fiber length, for the above reason, and therefore, the effect of the biased cut distribution becomes less and less, and thus the improvement of the yarn unevenness cannot be attained.

When, however, the polyester staple fibers are cut to the biased cut distribution under a combination of a requirement satisfying the equations (3) and (4) and the coarse denier staple fiber satisfying the equation (1), the yarn unevenness is surprisingly sharply improved.

Namely, when the fine denier staple fiber only is used, a processability of the staple fiber in a carding machine generally becomes poor. In the present invention, as described above, the coarse denier staple fiber is blended to obtain a support of fine denier staple fibers by the coarse denier staple fibers, and to further enhance the above effect, preferably the coarse denier staple fibers and the fine denier staple fibers are cut in the biased cut distribution, respectively, and the fiber length distribution of the coarse denier staple fiber is partially superimposed on or at least continued to the fiber length distribution of the fine denier staple fiber, in the present invention. An effect of the fiber length distribution against the processability in the carding machine under the condition satisfying the equations (3) and (4) is much better when the coarse denier staple fibers are cut in the biased cut distribution and a minimum fiber length of the biased cut distribution of the coarse denier staple fibers is made the same as a fiber length of the fine denier staple fibers cut to a square cut, compared with a case in which the coarse denier staple fibers and the fine denier staple fibers are cut in the square cut, respectively. When the both staple fibers are cut in the biased cut distribution and the minimum fiber length of the coarse denier staple fiber is made the same length as a maximum fiber length of the fine denier staple fiber, the processability in the carding machine is further improved. Most preferably, the both staple fibers are cut in the biased cut distribution and the maximum fiber length of the fine denier staple fibers is made larger than the minimum fiber length of the coarse denier staple fibers, i.e., a superimposed portion shown in FIG. 2 as the numeral 5 is arranged between the two fiber length distributions. In this case, it appears that the supporting of the fine denier staple fiber by the coarse denier staple fiber when passing through the carding machine is enhanced, because the staple fibers having the coarse denier and the long fiber length are arranged among the staple fibers having the fine denier and the short fiber length in the superimposed portion 5 of the total fiber length distribution.

Preferably, a width of the superimposed portion 5 in the total fiber length distribution is determined to be a value of one third or less of a width of the total fiber length distribution. If the width of one third or more is adopted, e.g., the fiber length of the fine denier staple fiber is made longer, the processability of the staple fibers in the carding machine becomes poor and the yarn unevenness is often generated. On the other hand, if the fiber length of the coarse denier staple fiber is shortened, although the processability of the staple fibers in the carding machine is improved, another problem arises in that the strength of the obtained spun yarn is low.

Therefore, preferably the maximum fiber length and the minimum fiber length in the coarse denier staple fiber and the fine denier staple fiber satisfy the equation (5), respectively.

Note, when two types of the staple fibers, i.e., the coarse denier staple fiber and the fine denier staple fiber, are used in the present invention, it is possible to obtain a required effect, but a staple fibers having a medium denier can be used by blending same with the above-mentioned staple fibers.

Preferably, a number of crimps of the coarse denier staple fiber used for the polyester and cotton blended yarn in accordance with the present invention is between 9 per inch to 15 per inch, more preferably, between 11 per inch to 14 per/inch. When the number of crimps is less than 9, an entanglement between the staple fibers is reduced, and unpreferably, the processability of the staple fibers in the carding process in a spinning process becomes poor. Conversely, when the number of crimps is more than 15 per inch, the entanglement between each staple fiber becomes too strong, the staple fibers cannot be easily opened, and unpreferably, a uniform blending with the fine denier staple fibers cannot be obtained.

Preferably the number of crimps of the fine denier staple fiber is between 11 per inch to 17 per inch, more preferably, between 13 per inch to 15 per inch. When the number of crimps is less than 11, an entanglement between the staple fibers is reduced, and unpreferably, the processability of the staple fibers in the carding process becomes poor. Conversely, when the number of crimps is more than 15 per inch, the entanglement between each staple fibers becomes too strong, the staple fibers cannot be easily opened, and unpreferably, a uniform blending with the coarse staple fibers cannot be obtained.

A polyethylene terephthalate is suitable as the polyester in the present invention, but a copolymerizated polyester in which a part of an acid component and/or a diol component is replaced by a dicarboxylic acid such as an isophthalic acid, 5×sodium sulfoisophthalic acid or the like, or a diol such as a diethylene glycol, a 1.4.butanediol, a polyethylene glycol or the like can be used. A delustering agent, an optical brightener, an antistatic agent, a flameproofing agent or the like may be added to the polyester.

A cotton fiber having a quality standard including a micronaire fineness of between 3.0 and 4.9 and a mean fiber length of between 27 mm and 42 mm is preferably used as a cotton fiber of the polyester and cotton blended yarn in accordance with the present invention. The blending ratio of the cotton fiber is preferably between 35 weight % and 65 weight % for the blended yarn. A range of a yarn count used in the blended yarn in accordance with the present invention and expressed by the English counting system is between 28 and 120.

As described above, the polyester and cotton blended yarn in accordance with the present invention is a spun yarn having a soft touch, superior bulkiness and resiliency, and less yarn unevenness, which are high standards not obtained by a conventional prior art and are obtained by using the coarse denier staple fibers and the fine denier staple fibers satisfying the equations (1) to (4), respectively. The effect of the polyester and cotton blended yarn in accordance with the present invention can be further enhanced by using staple fibers further satisfying the equations (1) to (5).

Further, in accordance with the present invention, it is possible to improve the processability of the polyester staple fibers in the carding machine by using, in the blended state, the coarse denier polyester staple fiber and the fine denier polyester staple fiber satisfying the equation (1), adopting fiber lengths of the staple fiber satisfying the equations (3) and (4), and particularly, using the biased cut distribution of the fiber length satisfying the equation (5), against a generation of the neps and an increase of the yarn unevenness caused by an inferior processability in the carding machine, which are a problem in the spinning process when a conventional fine denier staple fiber is used.

A polyester staple fiber stock as a second object of the present invention will be explained hereafter.

A blending ratio $M_1$ expressed by a weight % and of the coarse denier polyester staple fiber in the polyester staple fiber stock must be within a range satisfying the equation $65 \geqq M_1 \geqq 5$, more preferably a range satisfying the equation $40 \geqq M_1 \geqq 10$, to obtain a blended yarn having a number of staple fibers satisfying the equation (2).

Namely, the following relationship is established between the mean numbers of the staple fibers and the blending ratio $M_1$ of the coarse denier polyester staple fiber.

$$M_1 = \frac{D_1 N_1}{D_1 N_1 + D_2(N - N_1)} \times 100 = \frac{D_1/D_2}{D_1/D_2 + \left[\frac{N}{N_1} - 1\right]} \times 100$$

When the deniers $D_1$ and $D_2$ satisfy the equation $4.5 \geqq D_1/D_2 \geqq 1.25$, and the number of staple fibers N and $N_1$ satisfy the equation $0.30 \geqq N_1/N \geqq 0.05$, a maximum value and a minimum value of the blending ratio $M_1$ are as follows.

The maximum value for the blending ratio $M_1$ is obtained by adding 4.5 to the above equation as $D_1/D_2$ and 0.3 to the above equation as $N_1/N$, and the minimum value of 6.2% is obtained by adding 1.25 to the above equation as $D_1/D_2$ and 0.05 to the above equation as $N_1/N$.

Therefore, the useful blending ratio $M_1$ can be defined by the equation $65 \geqq M_1 \geqq 5$.

When the coarse denier polyester staple fiber is blended with the fine denier polyester staple fiber, the denier $D_2$ of which is within the above-mentioned range, at a low blending ratio, the staple fibers are likely to behave in an individual manner and are not uniformly blended, and this behavior is likely to become a source of the yarn unevenness.

It was considered that one of the above-mentioned sources stems from the phenomenon in which, the denier $D_2$ of the fine denier staple fiber is within the above-mentioned range, the surface of the fine denier staple fiber is remarkably increased, and therefore, friction between the staple fibers becomes larger, resulting in an uneven blending of the fine denier staple fibers and the coarse denier staple fibers. To overcome this drawback, preferably two or more types of the polyester staple fibers are blended, most preferably in a substantially uniform state, in a packing bale to be transported from a process of manufacturing the polyester staple fiber to a spinning process thereof.

Namely, to obtain the second object of the present invention, the inventors of the present invention provide a polyester staple fiber stock used for a polyester and cotton blended yarn, wherein the two or more types of polyester staple fibers satisfying the following equations are preblended in a bale-like state.

$$D_1/D_2 \geqq 1.25 \quad (1)$$
$$1.8 \geqq D_1 \geqq 1.0 \quad (6)$$
$$1.0 > D_2 \geqq 0.4 \quad (7)$$
$$65 \geqq M_1 \geqq 5 \quad (8)$$
$$95 \geqq M_2 \geqq 35 \quad (9)$$
$$16.1\, D_i + 26 \geqq L_i \geqq 10.2\, D_i + 1.0 \quad (3)$$
$$(i = 1, 2)$$
$$44 \geqq L_1 \geqq 1.18\, L_2 \quad (4)$$

Wherein $D_1$ stands for a fineness of a coarse denier staple fiber and is expressed by de, $D_2$ stands for a fineness of a fine denier staple fiber and is expressed by de, $M_1$ stands for a blending ratio of the coarse denier staple fiber and is expressed by weight %, $M_2$ stands for a blending ratio of the fine denier staple fiber and is expressed by weight %, $L_1$ stands for a mean fiber length of the coarse denier staple fiber and is expressed in mm, $L_2$ stands for a mean fiber length of the fine denier staple fiber and is expressed in mm.

A general method of manufacturing the polyester staple fiber will be now explained.

A molten polymer is extruded from nozzles of a spinneret, spun to a tow, and accommodated in a can as a sub tow of raw yarn in a spinning process. Next, in a drawing process, a plurality of sub tows are collected as a tow of raw yarn on a creel, a drawing process is applied to the tow, while heating, and a heat set process in a stretched state, a crimping process, and a heat treatment process in a relaxed state are sequentially applied. Finally, the treated tow is cut to form staple fibers having a predetermined length, and the obtained staple fibers are then packed in a bale.

In a conventional spinning process, a bale composed of the coarse denier staple fibers and a bale composed of the fine denier staple fibers are separately prepared, and groups of the two or more types of the staple fibers constituting a fiber block, respectively, are blended and opened. Therefore, a problem arises in that the opening of the coarse denier staple fibers is very easy and the opening of the fine denier staple fibers is difficult, for the reasons described above.

This problem can be solved by using the polyester staple fiber stock in which the staple fibers are preblended in a bale-like state in accordance with the present invention.

A preferable apparatus for manufacturing the polyester staple fiber stock will be explained with reference to FIG. 3.

Namely, a tow $T_1$ of coarse denier fibers and a tow $T_2$ of fine denier fibers, separately applied with a drawing process, a crimping process and a heat set process, are fed under a high tension condition by tension bars 11*a* and 11*b* through guide rollers 12*a* and 12*b* to cutters 14*a* and 14*b*, respectively, and are cut to different fiber lengths. Each cut fiber $S_1$ and $S_2$ drops down under its own weight and is blown out by pressurized air injected in the directions shown by arrows 16*a* and 16*b* from pressure nozzles 15*a* and 15*b* arranged below each cutter, is opened and blended in a chute 13, and is dropped on a conveyor 19 driven by a roller 18, to form the polyester staple fiber stock. Numeral 20 denotes an exhaust opening for the pressurized air. An openability of the tow is improved by feeding the tows under a high tension, respectively, so that the coarse denier staple fibers $S_1$ and the fine denier staple fibers $S_2$ can be uniformly blended.

The fine denier staple fibers $S_2$, which are particularly difficult to open, can be easily opened by blowing the pressurized air in a lateral direction form the pressure nozzle 15*b*, onto the staple fiber $S_2$ cut by the cutter 14*b* which the drops down in a chipped state.

A staple fiber stock thus obtained by blending two types of staple fibers is packed into a ball, e.g., a bale having a weight of 200 kg.

Figure 3:
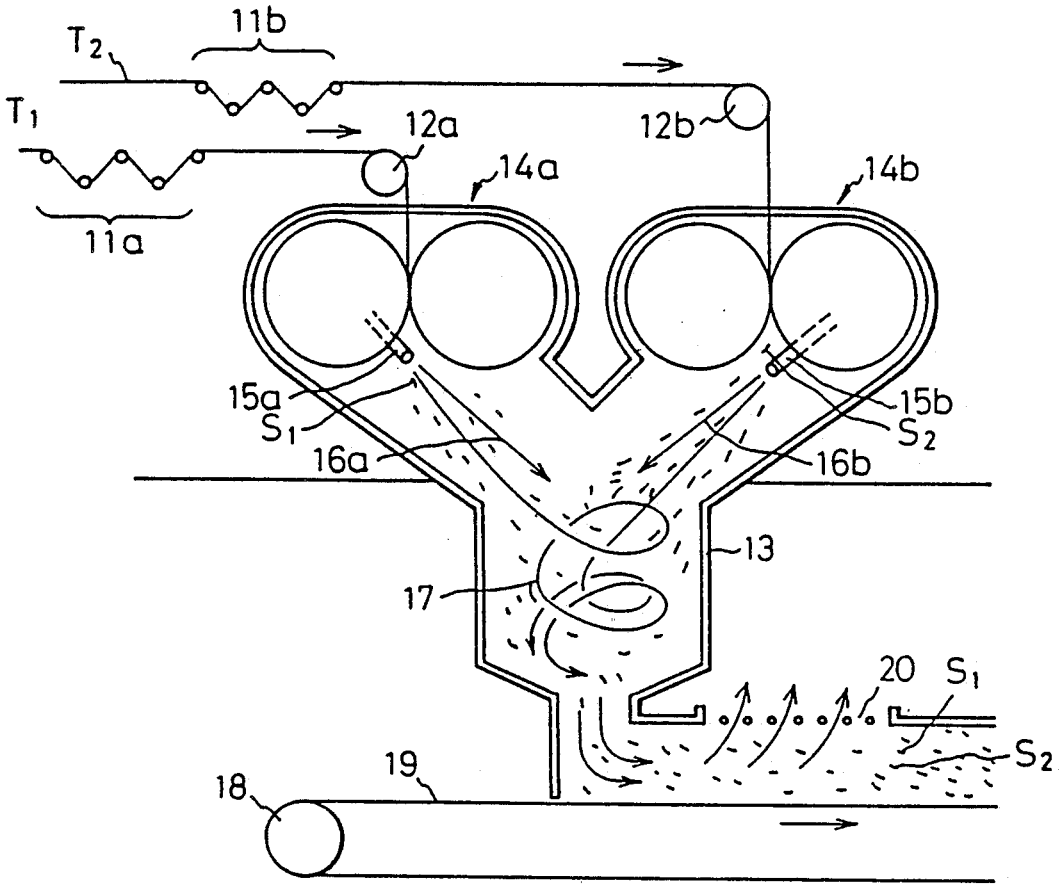
FIG. 3 is a front view schematically illustrating an example of an apparatus for manufacturing the polyester staple fiber stock in accordance with the present invention.

When three types of tows are cut, the three tows are cut to correspondingly different fiber lengths by an apparatus capable of blending three types of fibers, because another cutter has been added to the apparatus shown in FIG. 3, and thus obtained the blended staple fibers are packed into a bale.

The polyester staple fibers stock is a staple fiber stock fed by packing into a bale by the opening process of a fiber making process. Accordingly the two or more types of staple fibers constituting the staple fiber stock are uniformly blended in the staple fiber stock, so that when spinning is carried out using this staple fiber stock, it is possible to minimize the generation of the neps and obtain a blended yarn having less yarn unevenness.

Various examples of the polyester and cotton blended yarn in accordance with the present invention, and comparative examples thereof, will be now explained.

Before the explanation of the examples, the methods of measuring the evaluation items of a spun yarn, and a woven fabric and a knitted fabric obtained by using the spun yarn, are explained.

The method of measuring a fiber length is based on the following Japanese Industrial Standard.

| | |
|---|---|
| Cotton | JIS L 1019 5.2.1 (Sorter Method) for Mean Fiber Length |
| Polyester fiber | JIS L 1015 7.4.1 (Method A) |

BS, BR represent a resiliency, BS denotes a mean stiffness, and BR denotes a mean flexural modulus. BS, BR are measured by the JIS L 1096 6, 20 3, C (Loop Compression Method).

The uniformity U% and number of neps are measured by an evenness tester KET 80B supplied by KEISOKUKI KOGYO KK. The number of defects in the yarn is measured by a Uster Classimat Tester supplied by Zellweger Uster Co., and expressed by a total number of yarn defects measured and divided into 16 classifications.

An organoleptic test is based on a relative criteria obtained from ten inspectors, and is evaluated on the basis of the following standard.

: Eight inspectors or more judge as good,
: Six inspectors or more judge as good,
Δ: Five inspectors or more judge as inferior,
x: Eight inspectors or more judge as inferior.

EXAMPLES 1 TO 4, COMPARATIVE EXAMPLES 1 TO 4

A chip of a polyethylene terephthalate having an inherent viscosity of 0.65 was melted at 300° C., extruded at 285° C. through a spinneret having 1200 holes, and wound at a speed of 1000 m/min. At this time, undrawn yarns having different deniers were prepared by varying the quantities extruded from the spinneret. The obtained yarns were gathered to make a tow of 400,0000 denier, and the tow was applied successively with a drawing process at a drawing ratio of 2.8, a heat treatment process at 200° C. under a stretched condition, and a crimping process and heat treatment process in an environment of 140° C. under a relaxed condition, to produce five drawn tows in which a denier of each staple fiber thereof was 0.4 de, 0.8 de, 1.0 de, 1.5 de or 1.7 de.

When two types of tows were used, the two tows were cut to various fiber lengths by the apparatus shown in FIG. 3, and the blended staple fibers were packed into a 200 kg bale.

Further, Egyptian cotton and American cotton were used as the cotton fiber, respectively, and polyester staple fibers having a square cut and a denier of 0.4 de, 0.8 de, 1.0 de, 1.5 de or 1.7 de, respectively, were used in the combinations shown in Table 1. The cotton fibers were applied successively with a blowing process, a carding process, and a combing process or the like, and the polyester staple fibers were applied successively with a scutching process, a carding process, and a preliminary drawing process, the fibers were blended at a drawing process, and blended yarns having English cotton yarn counts of 30s and 50s corresponding to Examples 1 to 4 were obtained.

A plain weave fabric in which the blended yarn 50s were used as a warp yarn and a weft yarn and having a warp density of 144 per inch and a weft density of 80 per inch were woven, the woven fabric was applied with a conventional finishing process, and the qualities thereof evaluated. The results are shown in Table 2.

A knitted fabric having a 28 gauge T cloth design was knitted from a blended yarn of 30s, the knitted fabric was applied with a conventional finishing process, and the qualities thereof were evaluated. The results are shown in Table 2.

In Comparative Examples 1 to 4, the same cotton fibers and polyester staple fibers having the same denier as in Examples 1 to 4 were used, except that the fiber lengths were different from those of Examples 1 to 4, or a polyester staple fiber constituted only with fine denier staple fiber was used, and blended yarns were spun from the above cotton fiber and the polyester staple fibers by the same process as in Examples 1 to 4. A woven fabric and a knitted fabric were prepared from the above blended yarns, and the qualities of the fabrics were evaluated. The results are shown in Table 2.

As can be seen from Table 2, the number of neps observed in the card process is reduced, the processability in a carding machine is remarkably improved, and a blended yarn having superior yarn qualities is obtained in the Examples of the present invention.

In the Comparative Examples, however, a spun yarn such as in Comparative Examples 1 and 3, using only fine denier polyester staple fibers, has an inferior processability in the carding machine, and even if a coarse denier polyester staple fiber was blended, a uniform blending of the fine denier staple fibers with the coarse denier staple fibers was difficult and the processability in the carding machine and the yarn qualities were inferior when fine denier staple fibers and coarse denier staple fibers having the same fiber length as that of the fine denier staple fibers were used, as in Comparative Example 3, or when fine denier staple fibers and coarse denier staple fibers having different fiber lengths from that of the fine denier staple fiber, but the equations (3) and (4) were not satisfied, were used as in Comparative Example 4.

TABLE 1

| | | Examples | | | | Comparative Examples | | | |
|---|---|---|---|---|---|---|---|---|---|
| Constitution of Spun Yarn | | 1 | 2 | 3 | 4 | 1 | 2 | 3 | 4 |
| Cotton Fiber: | | | | | | | | | |
| Micronaire Fineness | μg/in | 4.4 | 3.3 | 3.3 | 4.4 | 3.3 | 4.4 | 3.3 | 4.4 |
| Mean Fiber Length | mm | 28 | 37 | 37 | 28 | 37 | 28 | 37 | 28 |
| Polyester Fiber: | | | | | | | | | |
| de × Fiber Length | de × mm (%) | 0.4 × 25 (60) | 0.4 × 25 (30) | 0.8 × 32 (60) | 0.8 × 32 (60) | 0.4 × 25 (100) | 0.4 × 32 (60) | 0.8 × 32 (100) | 0.8 × 32 (60) |
| | | | 0.8 × 32 (40) | 1.0 × 38 (20) | | | | | 1.7 × 51 (40) |
| | | 1.5 × 38 (40) | 1.5 × 38 (30) | 1.7 × 44 (20) | 1.7 × 44 (40) | | 1.5 × 32 (40) | | |
| Number N | number | 145 | 132 | 171 | 145 | 205 | 145 | 186 | 144 |
| Number $N_1$ | number | 18 | 14 | 28 | 21 | 0 | 18 | 0 | 21 |
| Fiber Length $L_1$ | mm | 38 | 38.0 | 44.0 | 44.0 | — | 32.0 | — | 51.0 |
| Fiber Length $L_2$ | mm | 25.0 | 25.0 | 32.0 | 32.0 | 25.0 | 32.0 | 32.0 | 32.0 |
| Blending Ratio of polyester | % | 65 | 65 | 50 | 50 | 65 | 65 | 50 | 50 |

TABLE 1-continued

| Constitution of Spun Yarn | | Examples 1 | 2 | 3 | 4 | Comparative Examples 1 | 2 | 3 | 4 |
|---|---|---|---|---|---|---|---|---|---|
| Yarn Count | Nec | 50 | 50 | 30 | 30 | 50 | 50 | 30 | 30 |

TABLE 2

| Quality Evaluation | | | Examples 1 | 2 | 3 | 4 | Comparative Examples 1 | 2 | 3 | 4 |
|---|---|---|---|---|---|---|---|---|---|---|
| Processability of Polyester Fiber in Card | Number of Neps in Card Sliver | Number/6 g | 16.5 | 13.8 | 12.1 | 11.7 | 47.5 | 38.6 | 29.2 | 25.5 |
| Yarn Quality | Uniformity | U % | 10.9 | 11.1 | 10.5 | 10.9 | 12.3 | 13.1 | 12.5 | 13.8 |
| | Number of Neps | Number/1000 m | 6.7 | 48 | 58 | 75 | 205 | 187 | 182 | 165 |
| | Number of Defects in Yarn | Number/100,000 m | 186 | 167 | 142 | 170 | 637 | 562 | 438 | 587 |
| Evaluation of Woven Fabric | Soft Handling | Organoleptic Test | | | | | | - | | |
| | Bulging, Bulkiness | Organoleptic Test | | | | | X | X-Δ | | |
| | Resiliency BS | g | 0.97 | 1.03 | | | 0.87 | 0.90 | | |
| | Resiliency BR | % | 70.3 | 72.4 | | | 50.8 | 60.7 | | |
| | Luster | Organoleptic Test | | | | | X | X-Δ | | |
| Evaluation of Knitted Fabric | Soft Handling | Organoleptic Test | | | | | | | | Δ |
| | Bulging, Bulkiness | Organoleptic Test | | | | | | | X | Δ |
| | stiffness | Organoleptic Test | | | | | | | X | Δ |

EXAMPLE 5

Polyester staple fibers having a denier of 0.4 de and 1.5 de were used from among the polyester staple fibers used in the Examples 1 to 4, but the square cut distribution of the polyester staple fiber of 1.5 was changed to a biased cut distribution. The American cotton shown in Table 3 was used as the cotton fiber, and the blended yarn was prepared by the same method as in Examples 1 to 4, whereby a woven fabric having the same constitution as that in Examples 1 to 4 was obtained. The results are shown in Table 4. In Example 5, the number of neps in the card process is reduced, the processability in a carding machine is good, and a blended yarn having superior yarn qualities was obtained as in Examples 1 to 4.

TABLE 3

| Constitution of Spun Yarn | | Example 5 |
|---|---|---|
| Cotton Fiber: | | |
| Micronaire Fineness | μg/in | 4.4 |
| Mean Fiber Length | mm | 28 |
| Polyester Fiber: | | |
| de × Fiber Length | de × mm (%) | 0.4 × 25 (60) 1.5 × 25-38 (40) |
| Number N | Number | 121 |
| Number $N_1$ | Number | 18 |
| Fiber Length $L_1$ | mm | 31.5 |
| Fiber Length $L_2$ | mm | 25.0 |
| Blending Ratio of Polyester | % | 65 |
| Yarn Count | NeC | 50 |

TABLE 4

| Quality Evaluation | | | Example 5 |
|---|---|---|---|
| Processability of Polyester Fiber in Card | Number of Neps in Card Sliver | Number/6 g | 12.4 |
| Yarn Quality | Uniformity | U % | 10.5 |
| | Number of Neps | Number/1000 m | 56 |
| | Number of Defects in Yarn | Number/0.1 million m | 161 |
| Evaluation of Woven | Soft Handling | Organoleptic Test | |
| | Bulging, Bulkiness | Organoleptic Test | |

TABLE 4-continued

| Quality Evaluation | | | Example 5 |
|---|---|---|---|
| Fabric | Resiliency BS | g | 0.93 |
| | Resiliency BR | % | 61.5 |
| | Luster | Organoleptic Test | |

EXAMPLES 6 TO 12

Five types of drawn tows of the polyester fiber having deniers of 0.4 de, 0.8 de, 1.0 de, 1.5 de or 1.7 de, respectively, and prepared by the same method as in Examples 1 to 4, were cut in a biased cut distribution and formed in the combinations shown in Table 5.

Cotton fibers were applied successively with a blowing process, a carding process, and a combing process or the like, and the polyester staple fibers were applied successively with a scutching process, a carding process and a preliminary drawing process, the fibers were blended at a drawing process, and blended yarns having English cotton yarn counts of 30s and 50s were obtained.

A plain weave fabric in which the blended yarn 50s was used as a warp yarn and a weft yarn having a warp density of 144 per inch and a weft density of 88 per inch were woven, the woven fabric was applied with a conventional finishing process, and the qualities thereof evaluated. The results are shown in Table 6.

A knitted fabric having a 28 gauge T cloth design was knitted from the blended yarn of 30s, the knitted fabric was applied with a conventional finishing process, and the qualities thereof were evaluated. The results are shown in Table 6.

Blended yarns such as the blended yarns in the Examples 8 and 9, in which both the fine denier staple fiber and the coarse denier staple fiber are cut in a biased cut distribution and a minimum fiber length of the coarse denier staple fiber was made the same as the fiber length of a maximum fiber length of the fine denier staple fiber were used, and blended yarns such as the blended yarns obtained in the Examples 6, 7, 10, 11 and 12, in which a minimum fiber length of the coarse denier staple fiber was shorter than a maximum fiber length of the fine denier staple fiber showed a much better processability in the carding machine than those in Examples 1 to 5.

Further, as can be seen in the Examples 11 and 12, even if a blending ratio of the polyester staple fiber is reduced to 35%, the polyester and cotton blended yarn in accordance with the present invention can maintain superior yarn qualities.

TABLE 5

| Constitution of Spun Yarn | | Examples 6 | 7 | 8 | 9 | 10 | 11 | 12 |
|---|---|---|---|---|---|---|---|---|
| Cotton Fiber: | | | | | | | | |
| Micronaire Fineness | μg/in | 3.3 | 4.4 | 4.4 | 3.3 | 4.4 | 3.3 | 4.4 |
| Mean Fiber Length | mm | 37 | 28 | 28 | 37 | 28 | 37 | 28 |
| Polyester Fiber: | | | | | | | | |
| de × Fiber Length | de × mm (%) | 0.4 × 25–32 (30) 0.8 × 25–32 (40) 1.5 × 30–38 (30) | 0.4 × 25–32 (60) 1.5 × 30–38 (40) | 0.4 × 25–32 (60) 1.5 × 30–38 (40) | 0.8 × 25–32 (60) 1.0 × 32–40 (20) 1.7 × 32–40 (20) | 0.8 × 25–32 (60) 1.7 × 30–38 (40) | 0.4 × 25–32 (30) 0.8 × 25–32 (40) 1.5 × 30–38 (30) | 0.4 × 25–32 (60) 1.5 × 30–38 (40) |
| Number N | Number | 100 | 121 | 121 | 94 | 88 | 54 | 65 |
| Number $N_1$ | Number | 14 | 18 | 18 | 28 | 21 | 7 | 10 |
| Fiber Length $L_1$ | mm | 34.0 | 34.0 | 36.0 | 36.0 | 34.0 | 34.0 | 34.0 |
| Fiber Length $L_2$ | mm | 28.5 | 28.5 | 28.5 | 28.5 | 28.5 | 28.5 | 28.5 |
| $\frac{1}{3}(L_{1max} + 2L_{2min})$ | mm | 32.7 | 32.7 | 34.7 | 34.7 | 32.7 | 32.7 | 32.7 |
| $L_{2max}$ | mm | 32.0 | 32.0 | 32.0 | 32.0 | 32.0 | 32.0 | 32.0 |
| $L_{1max}$ | mm | 30.0 | 30.0 | 32.0 | 32.0 | 30.0 | 30.0 | 30.0 |
| $\frac{1}{3}(2L_{2max} + L_{2min})$ | mm | 29.7 | 29.7 | 29.7 | 29.7 | 29.7 | 29.7 | 29.7 |
| Blending Ratio of Polyester | % | 65 | 65 | 65 | 50 | 50 | 35 | 35 |
| Yarn Count | NeC | 50 | 50 | 50 | 30 | 30 | 50 | 50 |

TABLE 6

| Quality Evaluation | | | Examples 6 | 7 | 8 | 9 | 10 | 11 | 12 |
|---|---|---|---|---|---|---|---|---|---|
| Processability of Polyester Fiber in Card | Number of Neps in Card Sliver | Number/6 g | 6.1 | 7.4 | 8.5 | 4.1 | 3.6 | 6.1 | 7.4 |
| Yarn Quality | Uniformity | U % | 10.4 | 10.1 | 10.3 | 9.8 | 10.2 | 10.7 | 10.8 |
| | Number of Neps | Number/1000 m | 34 | 44 | 50 | 19 | 23 | 23 | 48 |
| | Number of Defects in Yarn | Number/100,000 m | 70 | 86 | 93 | 51 | 63 | 65 | 95 |
| Evaluation of Woven Fabric | Soft Handling | Organoleptic Test | – | | | | | – | – |
| | Bulging, Bulkiness | Organoleptic Test | | – | – | | | | – |
| | Resiliency BS | g | 1.01 | 1.00 | 0.98 | | | 1.04 | 1.06 |
| | Resiliency BR | % | 78.1 | 73.4 | 71.5 | | | 76.3 | 73.1 |
| | Luster | Organoleptic Test | | | – | | | | – |
| Evaluation of Knitted Fabric | Soft Handling | Organoleptic Test | | | | | | | |
| | Bulging, Bulkiness | Organoleptic Test | | | | | – | | |
| | Stiffness | Organoleptic Test | | | | | – | | |

The blended yarns in Examples 1 to 12 provide a soft touch, which is one of the objects of the present invention, as well as an improved bulkiness and resiliency.

Further, in the blended yarn in accordance with the present invention, although the reason therefor is not clear, the luster on a surface of a fabric, e.g., a woven fabric, is remarkably improved and has a quality suitable for a high class woven fabric.

INDUSTRIAL APPLICABILITY

A fabric, i.e., a woven fabric and a knitted fabric having a superior bulkiness and a soft touch hitherto unobtainable, can be obtained by a polyester and cotton blended yarn, and it is possible to provide high class apparel or interior goods using this polyester and cotton blended yarn. Further, a polyester staple fiber stock in accordance with the present invention is useful for a stable spinning of the above-mentioned polyester and cotton blended yarn having a superior yarn quality, e.g., nep, yarn unevenness or the like.

We claim:

1. A polyester and cotton blended yarn composed of polyester staple fibers and cotton fibers, a blending ratio of the polyester staple fibers and the cotton fibers in the yarn being between 65 to 35 and 35 to 65, characterized in that a mean number (N) of the polyester staple fibers included in a cross section of said blended yarn is at least 10 or more, and the polyester staple fibers are constituted of two or more different type denier polyester staple fibers and include a coarse denier polyester staple fiber having a denier ($D_1$) which satisfied the equation $1.8 \geqq D_1 \geqq 1.0$ and a fine denier polyester fiber having a denier ($D_2$) which satisfies the equation $1.0 > D_2 \geqq 0.4$;

said two or more different type denier polyester staple fibers being blended with each other under a condition satisfying the following equations and being presented in a mutually blended state in the cross section of the blended yarn:

$$D_1/D_2 \geqq 1.25 \quad (1)$$

$$0.30\,N \geqq N_1 \geqq 0.05\,N \quad (2)$$

$$16.1\,D_i + 26 \geqq L_i \geqq 10.2\,D_i + 10 \quad (3)$$

-continued $$(i = 1, 2)$$
$$44 \geqq L_1 \geqq 1.18\ L_2 \quad (4)$$

wherein N stands for a mean number of the polyester staple fibers included in the cross section of the blended yarn, $N_1$ stands for a mean number of the coarse denier polyester staple fibers included in the cross section of the blended yarn, $L_1$ stands for a mean fiber length of the coarse denier polyester staple fibers and is expressed in mm, $L_2$ stands for a mean fiber length of the fine denier polyester staple fibers and is expressed in mm.

2. A blended yarn according to claim 1, characterized in that a fiber length distribution of the coarse denier polyester staple fibers is a biased cut distribution in which fiber lengths are continuously changed.

3. A blended yarn according to claim 2, characterized in that a fiber length distribution of the fine denier polyester staple fibers is a biased cut distribution in which fiber lengths are continuously changed, and each maximum value and each minimum value of fiber lengths of the coarse denier polyester staple fibers and fiber lengths of the fine denier polyester staple fibers satisfy the following equations:

$$\frac{(L_{1max} + 2L_{1min})}{3} \geqq L_{2max} \geqq L_{1min} \geqq \frac{(2L_{2max} + L_{2min})}{3} \quad (5)$$

wherein $L_{1max}$ stands for a maximum fiber length of the coarse denier polyester staple fiber and is expressed in mm, $L_{1min}$ stands for a minimum fiber length of the coarse denier polyester staple fiber and is expressed in mm, $L_{2max}$ stands for a maximum fiber length of the fine denier polyester staple fiber and is expressed in mm, $L_{2min}$ stands for a minimum fiber length of the fine denier polyester staple fiber and is expressed in mm.

4. A polyester staple fiber stock used for a polyester and cotton blended yarn, characterized in that said stock includes two or more different types of polyester staple fibers in a blended state and is packed into a packing bale to be transported from a process of manufacturing the polyester staple fiber to a spinning process thereof, and each staple fiber satisfies the following equations:

$$D_1/D_2 \geqq 1.25 \quad (1)$$
$$1.8 \geqq D_1 \geqq 1.0 \quad (6)$$
$$1.0 > D_2 \geqq 0.4 \quad (7)$$
$$65 \geqq M_1 \geqq 5 \quad (8)$$
$$95 \geqq M_2 \geqq 35 \quad (9)$$
$$16.1\ D_i + 26 \geqq L_i \geqq 10.2\ D_i + 1.0 \quad (3)$$
$$(i = 1, 2)$$
$$44 \geqq L_1 \geqq 1.18\ L_2 \quad (4)$$

wherein $D_1$ stands for a fineness of a coarse denier polyester staple fiber and is expressed by de, $D_2$ stands for a fineness of a fine polyester staple fiber and is expressed by de, $M_1$ stands for a blending ratio of the coarse denier polyester staple fiber and is expressed by weight %, $M_2$ stands for a blending ratio of the fine denier polyester staple fiber and is expressed by weight %, $L_1$ stands for a mean fiber length of the coarse denier polyester staple fiber and is expressed in mm, $L_2$ stands for a mean fiber length of the fine denier polyester staple fiber and is expressed in mm.

5. A polyester staple fiber stock used for a polyester and cotton blended yarn according to claim 4, characterized in that a fiber length distribution of the coarse denier polyester staple fibers is a biased cut distribution in which fiber lengths are continuously changed.

6. A polyester staple fiber stock according to claim 5, characterized in that a fiber length distribution of the fine denier polyester staple fibers is a biased cut distribution in which fiber lengths are continuously changed, and each maximum value and each minimum value of fiber lengths of the coarse denier polyester staple fiber and fiber lengths of the fine denier polyester staple fibers satisfy the following equation:

$$\frac{(L_{1max} + 2L_{1min})}{3} \geqq L_{2max} \geqq L_{1min} \geqq \frac{(2L_{2max} + L_{2min})}{3} \quad (5)$$

wherein $L_{1max}$ stands for a maximum fiber length of the coarse denier polyester staple fiber and is expressed in mm, $L_{1min}$ stands for a minimum fiber length of the coarse denier polyester staple fiber and is expressed in mm, $L_{2max}$ stands for a maximum fiber length of the fine denier polyester staple fiber and is expressed in mm, $L_{2min}$ stands for a minimum fiber length of the fine denier polyester staple fiber and is expressed in mm.

* * * * *